US008230775B2

(12) United States Patent
Vanni

(10) Patent No.: US 8,230,775 B2
(45) Date of Patent: Jul. 31, 2012

(54) SEALED CAPSULE FOR THE PREPARATION OF A BEVERAGE, IN PARTICULAR ESPRESSO COFFEE

(75) Inventor: Alfredo Vanni, Chieri (IT)

(73) Assignee: Luigi Lavazza S.p.A., Turin (IT)

( * ) Notice: Subject to any disclaimer, the term of this patent is extended or adjusted under 35 U.S.C. 154(b) by 522 days.

(21) Appl. No.: 12/376,227

(22) PCT Filed: Aug. 1, 2007

(86) PCT No.: PCT/IB2007/053027

§ 371 (c)(1),
(2), (4) Date: Feb. 3, 2009

(87) PCT Pub. No.: WO2008/015642

PCT Pub. Date: Feb. 7, 2008

(65) Prior Publication Data

US 2010/0000415 A1 Jan. 7, 2010

(30) Foreign Application Priority Data

Aug. 4, 2006 (EP) ..... 06425571

(51) Int. Cl.

| | |
|---|---|
| ***A47J 31/06*** | (2006.01) |
| ***A47G 19/14*** | (2006.01) |
| ***B65B 29/02*** | (2006.01) |
| ***B65D 81/34*** | (2006.01) |
| ***A23F 5/26*** | (2006.01) |

(52) U.S. Cl. ..... 99/295; 99/323; 426/77; 426/394; 426/433

(58) Field of Classification Search ..... 99/295, 99/323; 426/77, 84, 112, 394, 425–437
See application file for complete search history.

(56) References Cited

U.S. PATENT DOCUMENTS

| | | | | |
|---|---|---|---|---|
| 2,899,310 | A * | 8/1959 | Dale | 99/295 |
| 2,968,560 | A * | 1/1961 | Goros | 99/295 |
| 3,094,917 | A * | 6/1963 | Rombouts | 99/287 |
| 3,190,758 | A * | 6/1965 | Hauf | 426/391 |
| 3,411,431 | A * | 11/1968 | Moerlini et al. | 99/304 |
| 3,445,237 | A * | 5/1969 | Gidge | 426/77 |
| 3,770,457 | A * | 11/1973 | Makwinski et al. | 426/394 |
| 3,800,690 | A * | 4/1974 | Molenaar et al. | 99/295 |
| 4,158,329 | A * | 6/1979 | McKnight | 99/295 |
| 4,348,421 | A * | 9/1982 | Sakakibara et al. | 426/394 |
| 4,446,158 | A * | 5/1984 | English et al. | 426/79 |

(Continued)

FOREIGN PATENT DOCUMENTS

EP 0 398 530 A2 11/1990

(Continued)

*Primary Examiner* — Sebastiano Passaniti
(74) *Attorney, Agent, or Firm* — Sughrue Mion, PLLC

(57) ABSTRACT

A capsule (1) sealed without an internal filter. The capsule includes a cup-shaped body (2) with an outwardly projecting flange (2*a*), and a flexible lid (3) welded to the flange (2*a*) to define with the latter a sealed chamber (4) which is impermeable to oxygen and moisture and contains a quantity of granular material (5). The granular material (5) is first compressed inside the chamber (4) in a direction perpendicular to the plane containing the flange (2*a*), with a compressive load preferably of between 2 and 50 Kg per $cm^2$ of the average cross-sectional area of the chamber (4), so as to form a compact tablet (5) of the material. A vacuum is formed inside the chamber (4) to a degree such that the lid (3) adheres to the upper surface of the tablet (5).

8 Claims, 2 Drawing Sheets

U.S. PATENT DOCUMENTS

| | | | | |
|---|---|---|---|---|
| 5,343,799 | A * | 9/1994 | Fond | 99/295 |
| 5,347,916 | A * | 9/1994 | Fond et al. | 99/295 |
| 5,402,707 | A * | 4/1995 | Fond et al. | 99/295 |
| 5,472,719 | A | 12/1995 | Favre | |
| 5,633,026 | A * | 5/1997 | Gruenbacher | 426/77 |
| 5,834,046 | A * | 11/1998 | Turpin et al. | 426/107 |
| 5,948,455 | A | 9/1999 | Schaeffer et al. | |
| 6,068,871 | A * | 5/2000 | Fond et al. | 426/433 |
| 6,758,130 | B2 * | 7/2004 | Sargent et al. | 99/295 |
| 6,777,007 | B2 * | 8/2004 | Cai | 426/78 |
| 6,810,788 | B2 * | 11/2004 | Hale | 99/295 |
| 6,869,627 | B2 * | 3/2005 | Perkovic et al. | 426/77 |
| 7,287,461 | B2 * | 10/2007 | Halliday et al. | 99/295 |
| 7,412,921 | B2 * | 8/2008 | Hu et al. | 99/295 |
| 7,552,672 | B2 * | 6/2009 | Schmed | 99/295 |
| 7,815,955 | B2 * | 10/2010 | Bunke et al. | 426/433 |
| 2002/0035928 | A1 * | 3/2002 | Kataoka | 99/279 |
| 2005/0236415 | A1 * | 10/2005 | Ozasa et al. | 220/912 |
| 2005/0266122 | A1 * | 12/2005 | Franceschi | 426/77 |
| 2006/0165845 | A1 * | 7/2006 | Kaku et al. | 426/45 |
| 2009/0130270 | A1 * | 5/2009 | Cortese | 426/281 |
| 2010/0129512 | A1 * | 5/2010 | Accursi | 426/431 |
| 2010/0178404 | A1 * | 7/2010 | Yoakim et al. | 426/431 |
| 2010/0239733 | A1 * | 9/2010 | Yoakim et al. | 426/431 |
| 2011/0020499 | A1 * | 1/2011 | Richiger | 426/77 |

FOREIGN PATENT DOCUMENTS

| | | | |
|---|---|---|---|
| WO | 2006/021405 | A3 | 3/2006 |

* cited by examiner

SEALED CAPSULE FOR THE PREPARATION OF A BEVERAGE, IN PARTICULAR ESPRESSO COFFEE

CROSS REFERENCE TO RELATED APPLICATION

This application is a National Stage of International Application No. PCT/IB2007/053027 filed Aug. 1, 2007, claiming priority based on European Patent Application No. 06425571.4, filed Aug. 4, 2006, the contents of which are incorporated herein by reference in their entirety.

BACKGROUND OF THE INVENTION

The present invention relates to a sealed capsule, without an internal filter, for the preparation of a beverage, in particular espresso coffee, by means of pressurised extraction.

SUMMARY OF THE INVENTION

More specifically the invention relates to a capsule of the type comprising

- a cup-shaped body having an essentially flat, flange-like form at the top projecting radially outwards; and
- a flexible lid, welded to the flange-like form of the cup-shaped body so as to define with the latter a sealed chamber which is impermeable to oxygen and moisture and contains a quantity of material in the form of granules, in particular ground toasted coffee, for the preparation of a beverage, in particular espresso coffee, by means of pressurised extraction.

One object of the present invention is to provide a sealed capsule of the type initially defined, which allows better extraction of the beverage.

A further object of the invention is to provide a sealed capsule of limited size.

These and other objects are achieved according to the invention with a capsule of the type initially defined, characterized in that

- the granular material is first compressed inside said chamber in a direction perpendicular to the plane containing the flange, with a compressive load preferably of between 2 and 50 Kg per $cm^2$ of the average cross-sectional area of the chamber, so as to form a compact tablet of said material; and in that
- a vacuum is formed inside said chamber to a degree such that the lid adheres to the upper surface of said tablet.

BRIEF DESCRIPTION OF THE DRAWINGS

Further characteristic features and advantages of the invention will emerge from the detailed description which follows, provided purely by way of a non-limiting example, with reference to the accompanying drawings, in which.

DETAILED DESCRIPTION OF THE INVENTION

Figure 1:
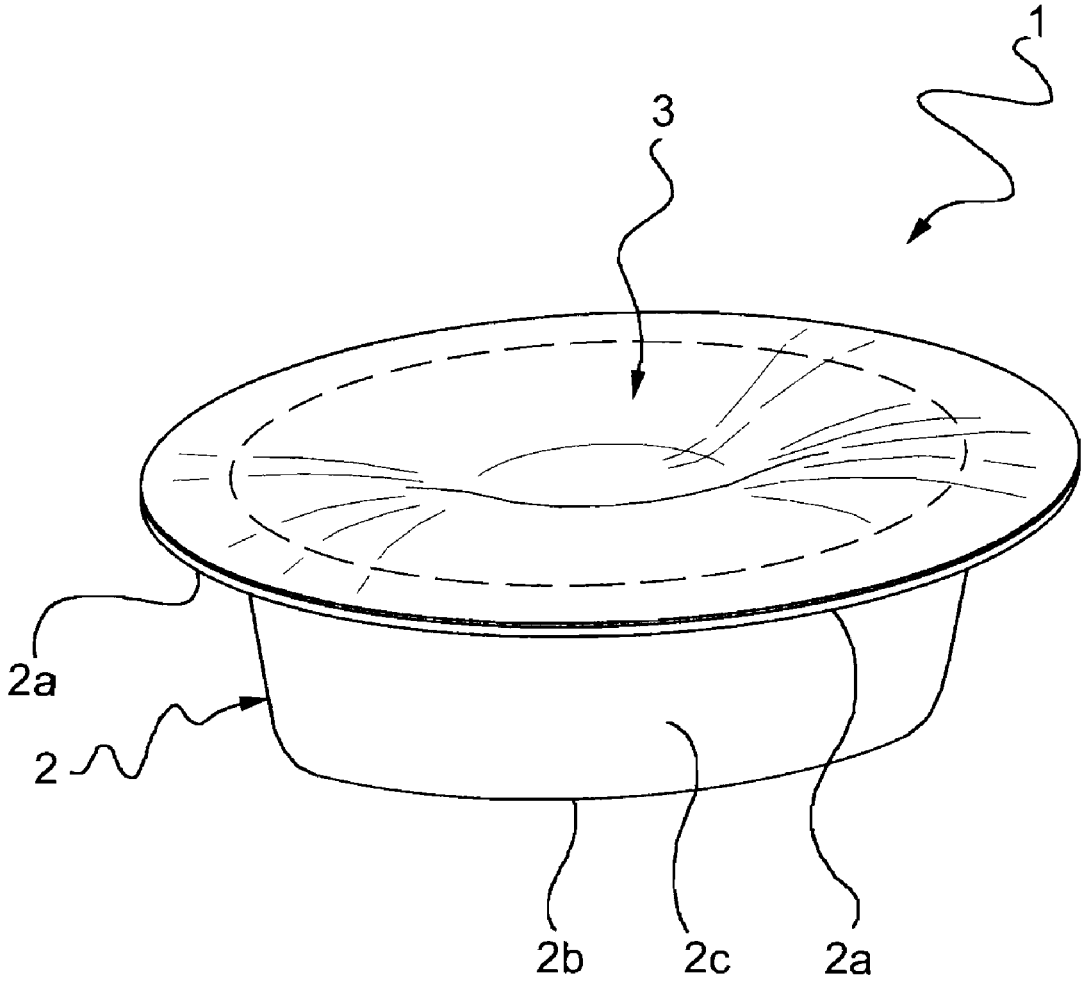
FIG. 1 is a perspective view of a sealed capsule, without internal filter, according to the present invention.

In the drawings 1 denotes overall a capsule according to the invention for the preparation of a beverage, in particular espresso coffee, by means of pressurised extraction.

The capsule is of the sealed type and is without an internal filter.

It comprises a cup-shaped body 2 which has at the top an essentially flat, flange-like form 2*a* which projects radially outwards.

The body 2 is conveniently made for example with a multilayer laminated structure, with an inner layer of polypropylene, a middle layer of EVOH (ethylene vinyl alcohol copolymer) and an outer layer of polypropylene.

Conveniently, although not necessarily, the wall thickness of the cup-shaped body 2 is greater in the region of the top flange 2*a* and then gradually diminishes to a minimum value in the region of the bottom wall 2*b*, where it has a value conveniently of between 150 and 400 μm, and preferably between 150 and 220 μm.

Figure 2:
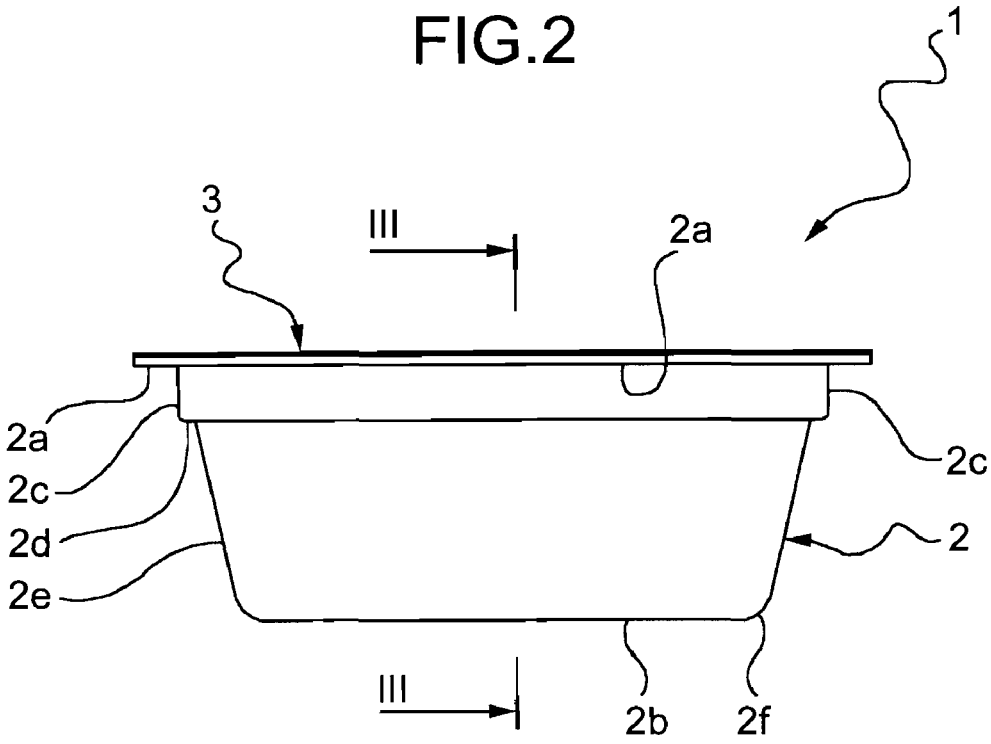
FIG. 2 is a side elevation view of the capsule according to FIG. 1.

In the embodiment shown (see in particular FIGS. 2 and 3) the cup-shaped body 2 has an upper portion 2*c* which is essentially cylindrical, followed by a stepped portion 2*d* where there is reduction in the cross-sectional diameter, and then by an essentially frustoconical portion 2*e*. The angle formed by the frustoconical wall 2*e* of the body 2 relative to the axis of the capsule is conveniently between 10° and 15° and is preferably equal to about 12°.

The frustoconical wall 2*e* is connected to the bottom wall 2*b* via an annular wall portion 2*f* having a rounded profile which is outwardly convex. This annular surface corresponds roughly to a quarter of a torus and has a radius R (FIG. 3) which conveniently is in the region of 1.5-2.5 mm.

Figure 3:
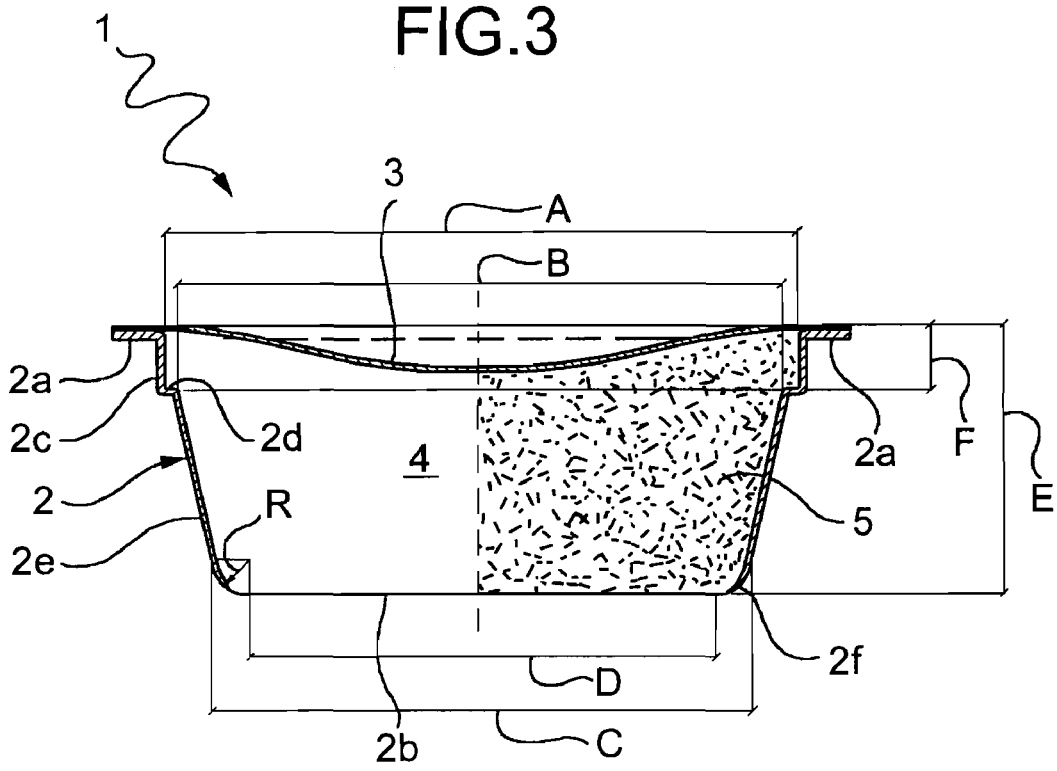
FIG. 3 is a cross-sectional view along the line III-III of FIG. 2.

Purely by way of example, with reference to FIG. 3, the cup-shaped body 2 has the following main dimensions:

- A (inner diameter of the roughly cylindrical portion 2*c*): between 35 and 45 mm, preferably equal to 40 mm;
- B (greater inner diameter of the frustoconical wall 2*e*): between 36 and 42 mm, preferably equal to about 38 mm;
- C (smaller inner diameter of the frustoconical wall 2*e*): between 32 and 36 mm, preferably equal to about 34.2 mm;
- D (diameter of the bottom wall 2*b*): between 39 and 43 mm, and preferably equal to about 41.2 mm;
- E (inner height of the cup-shaped body 2): between 15 and 19 mm, and preferably equal to 17 mm; and
- F (inner height of the essentially cylindrical portion 2*c*): between 3 and 4 mm, and preferably equal to 3.5 mm.

The capsule 1 also comprises a flexible lid 3 welded onto the flange-like form 2*a* of the cup-shaped body 2.

The lid 3 is for example made with a multilayer structure, with an inner layer of polypropylene and an outer layer of aluminium.

Welding between the edge of the flexible lid 3 and the flange 2*a* of the cup-shaped body 2 is performed thermally, for example by means of ultrasound.

The lid 3 has for example a thickness of between 30 and 90 μm and preferably of about 70 μm.

Together the flexible lid 3 and the cup-shaped body 2 define a sealed chamber, denoted by 4 in FIG. 3, which is impermeable to oxygen ($O_2$) and moisture.

The chamber 4 of the capsule contains a quantity of granular material for the preparation of a beverage, for example ground toasted coffee for the preparation of espresso coffee.

Preparation of the beverage is performed by means of pressurised extraction, using machines which are generally known per se.

Conveniently, according to the invention, the chamber 4 is filled with the granular material which is first compressed inside this chamber in a direction perpendicular to the plane containing the flange 2*a*, namely parallel to the plane of the bottom wall 2*b* of the capsule. The compressive load applied to the granular material is preferably between 2 and 50 kg per $cm^2$ of the average cross-sectional area of the chamber 4.

Compression of the granular material is performed so as to form a compact tablet of said material, namely having a certain form stability.

A vacuum is then formed inside the chamber 4 to a degree such that the flexible lid 3 adheres to the upper surface of said tablet, as shown in the right-hand part of FIG. 3.

Viewed from the outside, the flexible lid 3 therefore has an essentially concave configuration, with a main deformation or camber which is greater along the axis of the capsule. This deformation or camber may reach values of about 3-4 mm.

If the height E of the chamber 4 is between about 15 and 19 mm, the granular material 5 contained therein and compression thereof are such that it forms a compact tablet having a height of between about 12 and 15 mm and 15 and 19 mm, respectively.

In the currently preferred embodiment, the chamber 4 has a height of about 17 mm, and the granular material 5 and the load with which it is compacted are such that it forms a compressed tablet having a height which varies from 13 to 17 mm.

The capsule 1 is preferably intended, during use, to be perforated along the bottom wall 2 of the cup-shaped body 2, before injection of the extraction fluid which is conveniently performed through the lid 3.

With regard to this preliminary perforation, conveniently, as already mentioned above, the bottom wall 2*b* of the body 2 has a thickness of between 150 and 400 μm and preferably between 150 and 220 μm.

The capsule 1 formed with the dimensions indicated above is conveniently intended to receive, during use, an extraction fluid at a pressure of between 4 and 11 bar.

Preferably, although not necessarily, the capsule 1 according to the invention is intended to be used in a machine for extraction of the beverage comprising a capsule-holder part which can be engaged with and disengaged from the machine. In a manner known per se, this capsule-holder part has an essentially cup-shaped seat for receiving a capsule. In a manner likewise known per se, in this machine, for the purpose of extraction of the beverage, the flange of the capsule is first gripped against the top edge of the capsule-holder part.

Conveniently, the capsule 1 according to the invention is thus formed so that it has a height greater, by a predetermined amount (for example 3-4 mm), than that of the corresponding seat of the capsule-holder part so that, when the capsule is arranged in this seat, it projects above the top edge of the capsule-holder part.

Owing to this characteristic feature, for preparation of the beverage and before extraction of the latter, the capsule 1 according to the invention is first deformed and further compressed and this improves further the characteristics of the beverage obtained.

The sealed capsule according to the invention does not have an internal filter. In fact, the compacted tablet of compressed granular material is able to act itself as a filter bed during preparation and dispensing of the beverage.

In the case where the granular material is ground toasted coffee, the size of its granules is preferably between 180 and 400 μm, and the quantity of ground coffee contained inside the chamber 4 of the capsule is preferably between 6 and 12 g and is preferably equal to about 7.5 g.

Obviously, without modifying the principle of the invention, the embodiments and the constructional details may be widely varied with respect to that described and illustrated purely by way of a non-limiting example, without thereby departing from the scope of the invention as defined in the accompanying claims.

The invention claimed is:

1. A sealed capsule, for the preparation of a beverage, by means of pressurised extraction, comprising:

a cup-shaped body having a flange at the top projecting radially outwards; and a flexible lid, welded to the flange of the cup-shaped body so as to define with the latter a sealed chamber which is impermeable to oxygen and moisture and contains a quantity of material in the form of granules for preparation of the beverage, wherein the granular material is preliminarily compressed inside said chamber in a direction perpendicular to a plane containing the flange with a compressive load between 2 and 50 Kg per $cm^2$ of the average cross-sectional area of the chamber, so as to form a compact tablet of said material, and wherein a vacuum is formed inside said chamber to a degree such that the lid adheres to the upper surface of said tablet.

2. The capsule according to claim 1, wherein the cup-shaped body is substantially frustoconical and said chamber has a height roughly equal to half its average cross-sectional dimension.

3. The capsule according to claim 2, wherein said chamber has a height (E) of between about 15 and 19 mm and the granular material contained therein is such that the granular material forms a compressed tablet having a height of between about 12 and 15 mm and between about 15 and 19 mm, respectively.

4. The capsule according to claim 3, wherein said chamber has a height (E) of about 17 mm and the granular material contained therein is such that the granular material forms a compressed tablet having a height of between about 13 and 17 mm.

5. The capsule according to claim 1, wherein during use, the capsule is perforated beforehand along the bottom wall of the cup-shaped body before injection of an extraction fluid through the lid, the bottom wall of the cup-shaped body having a thickness of between 150 and 400 μm.

6. The capsule according to claim 5, wherein the bottom wall of the cup-shaped body has a thickness of between 150 and 220 μm.

7. The capsule according to claim 5, wherein the capsule is adapted to receive, during use, an extraction fluid at a pressure of between 4 and 11 bar.

8. The capsule according to claim 1, wherein the capsule contains ground roasted coffee, with a size of the coffee granules ranging between 180 and 400 μm.

* * * * *